United States Patent [19]

Gladden et al.

[11] Patent Number: 4,838,165

[45] Date of Patent: Jun. 13, 1989

[54] IMPEDED VELOCITY SIGNAL TRANSMISSION LINE

[75] Inventors: Ernest L. Gladden, Granby; Sanford B. Tavelli, Simsbury, both of Conn.

[73] Assignee: The Ensign-Bickford Company, Simsbury, Conn.

[21] Appl. No.: 44,039

[22] Filed: Apr. 30, 1987

[51] Int. Cl.[4] ..... C06C 5/00

[52] U.S. Cl. ..... 102/275.8; 102/275.1

[58] Field of Search ..... 102/202.3, 275.1, 275.3, 102/275.5, 275.8, 275.9

[56] References Cited

U.S. PATENT DOCUMENTS

| | | | |
|---|---|---|---|
| 2,008,046 | 7/1935 | Snelling | 102/275.1 X |
| 3,556,009 | 1/1971 | Thatcher | 102/275.9 X |
| 3,621,558 | 11/1971 | Welsh et al. | 102/275.1 X |
| 3,753,402 | 8/1973 | Menz et al. | 102/275.9 |
| 3,774,541 | 11/1973 | Bratton | 102/275.5 X |
| 4,220,087 | 9/1980 | Posson | 102/275.6 |
| 4,328,753 | 5/1982 | Kntensen et al. | 102/275.5 |
| 4,402,270 | 9/1983 | McCaffrey | 102/275.7 X |
| 4,493,261 | 1/1985 | Simon et al. | 102/275.8 X |
| 4,607,573 | 8/1986 | Thureson et al. | 102/275.5 X |
| 4,671,178 | 6/1987 | Curutchet | 102/275.8 X |

FOREIGN PATENT DOCUMENTS

| | | | |
|---|---|---|---|
| 752770 | 7/1956 | United Kingdom | 102/275.1 |

*Primary Examiner*—David H. Brown

*Attorney, Agent, or Firm*—Hayes & Reinsmith

[57] ABSTRACT

Blasting signal transmission tube comprising a length of elongated flexible hollow tube and a self-oxidizing combustible substance disposed within the tube for transmitting a blasting signal along the interior of the tube length, the hollow tube having a varying interior axial cross-sectional area at longitudinally spaced intervals along the tube length for reducing and controlling the velocity of the blasting signal. Also, a process for producing signal transmission tube comprising forming a length of elongated flexible hollow tube of predetermined interior cross section area; depositing a self-oxidizing combustible substance within the tube for transmitting a blasting signal along the interior of the tube length without destroying the tube; and introducing a plurality of discrete restrictions reducing the predetermined hollow tube interior cross-sectional area at longitudinally spaced intervals along the tube length for reducing and controlling the velocity of the blasting signal.

6 Claims, 2 Drawing Sheets

IMPEDED VELOCITY SIGNAL TRANSMISSION LINE

BACKGROUND OF THE INVENTION

This invention relates to blasting signal transmission line and in particular to blasting signal transmission line utilizing a hollow flexible tube and a combustible substance in the interior of the tube for transmitting a blasting initiation signal along the length of the tube.

In mining and other operations requiring blasting of rock or minerals or the like there is generally required a predetermined time between detonation of individual blasting charges. To detonate a plurality of these individual blasting charges, transmission lines are employed from a central initiating point to send a signal to initiate the detonation of the individual charges. Normally, these signal transmission lines consist of one or more main trunk lines connected to a plurality of down lines.

The availability of signal transmission line with only limited, fixed signal velocities has led to the use of separate delay units to control the time transmission of a blasting initiation signal. For example, detonating cord generally transmits an initiation signal at a rate between about 4,000 and 9,000 m/sec. (13,100 and 29,500 ft/sec.) To avoid the use of separate delay units, such detonating cord propagation rates would require the use of cord lengths in the range of 32 to 72 m (105 to 240 ft.) between charges to achieve the convention minimum required time delay interval of 8 milliseconds. in U.S. Pat. No. 4,402,270 to McCaffray there is disclosed a high detonation velocity detonating cord having a signal velocity of at least 6,500 m/sec. (21,000 ft./sec.) which may be modified by inserting elongated flexible blockage elements which completely block the hollow core of the cord at selected locations along the length of the cord. The detonating cord of this type not only has a very high signal velocity but also self destructs upon use.

Non destructing blasting signal transmission tubes have also been utilized to carry a detonating signal. These signal transmission tubes generally carry a signal at a considerably lower velocity than that of detonating cord so that a shorter tube length may be utilized to control the timing between charge detonation. As used herein, the term "signal transmission tube" refers to any detonating or deflagrating transmission line with, in the preferred embodiment, a flexible hollow tube and a self-oxidizing combustible substance disposed within or along the interior of the tube for carrying a detonating or deflagrating signal.

Such signal transmission tube may be any of the different available types, for example, shock tube having a detonating powder coated on the inner periphery of the tube as disclosed in U.S. Pat. No. 3,590,739 to Persson. Shock tube generally carries a pressure pulse signal at approximately 2,000 m/sec. (6,500 ft./sec.) Also available is transmission tube containing a loosely filling combustible substance inside the tube as disclosed in U.S. Pat. No. 4,290,366 to Janoski.

A signal transmission tube having a lower signal velocity than shock tube is disclosed in copending U.S. patent application Ser. No. 811,731 which discloses a transmission tube having a deflagrating substance on the inside of the tube to transmit a blasting initiation signal in a flame front at velocities up to about 1,500 m/sec. (4,900 ft./sec.).

While signal transmission tube can then be obtained in a variety of signal velocity capabilities, the specific velocity selected in each of these tubes is a function of the specific combustible substance used therein and the surface area of that substance available for combustion. Thus, the signal velocity of each of these tubes is essentially fixed upon production of the tube and cannot be modified thereafter. In addition, the sensitivity of the combustible mixture within each tube is generally related to the velocity of signal propagation so that the higher sensitivity mixtures are also the highest velocity mixtures. Consequently, in those systems where signal initiation sensitivity is important, the user is left with little option but to use the highest velocity signal transmission tubes.

Bearing in mind these and other deficiencies of the prior art, it is therefore a primary object of the present invention to provide signal transmission tube with improved control of blasting signal velocity.

It is another object of the present invention to provide signal transmission tube which has a controlled signal velocity substantially independent of the combustible substance contained therein.

It is a further object of the present invention to provide signal transmission tube for which signal velocity may be modified after production.

It is yet another object of the present invention to provide mechanical techniques for modifying signal velocity in signal transmission tube.

It is a further object of the present invention to provide a process for producing such improved signal transmission tube.

Other objects will be in part obvious and in part pointed out in more detail hereinafter.

A better understanding of the objects, advantages, features, properties and relations of the invention will be obtained from the following detailed description and accompanying drawings which set forth certain illustrative embodiments and are indicative of the various ways in which the principles of the invention are employed.

SUMMARY OF THE INVENTION

The present invention provides in one aspect a signal transmission tube comprising a length of elongated flexible hollow tube and a self-oxidizing combustible substance disposed within the tube for transmitting a blasting signal along the interior of the tube length, the hollow tube having a varying interior axial cross-sectional area at longitudinally spaced intervals along the tube length for reducing and controlling the velocity of the blasting signal.

In another aspect, the present invention provides a process for producing signal transmission tube comprising forming a length of elongated flexible hollow tube of predetermined interior cross section area; depositing a self-oxidizing combustible substance within said tube for transmitting a blasting signal along the interior of the tube length without destroying the tube; and introducing a plurality of discrete restrictions reducing the predetermined hollow tube interior cross-sectional area at longitudinally spaced intervals along the tube length for reducing and controlling the velocity of the blasting signal.

DETAILED DESCRIPTION OF THE INVENTION

Two specific embodiments of the signal transmission tube of the present invention are shown in FIGS. 1–4, wherein like numerals are used to designate like features of the invention.

Figure 1:
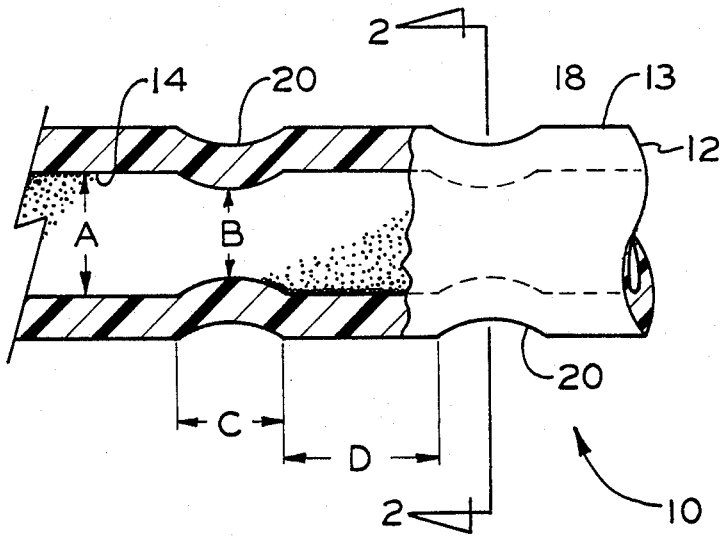
FIG. 1 is a side view, partially in section, of a first embodiment of the signal transmission tube of the present invention.
Figure 2:
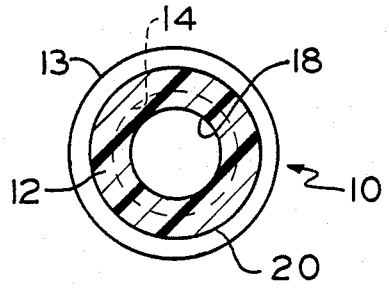
FIG. 2 is an axially cross-sectional view of a portion of the embodiment of FIG. 1.

In FIGS. 1 and 2 there are shown, respectively, longitudinal and axial views of a first embodiment of the present invention. Signal transmission tube 10 comprises a flexible elongated hollow plastic tube 12 of a predetermined length for transmitting a blast initiating signal between two desired points (not shown). Plastic tube 12 may be extruded by any conventional process from such materials as Surlyn 8940, an ionomer resin available from E. I. duPont DeNemours and Co., EEA (ethylene/acrylic acid copolymer), EVA (ethylene vinyl acetate) or the like. As shown herein, tube 12 has a single wall layer, although a plurality of wall layers may be utilized, for example, as disclosed in U.S. Pat. No. 4,607,573 to Thureson et al. As shown in FIG. 1, tube 12 is of nominal inner diameter "a", which diameter may be formed during the extrusion process.

Adhered to inner wall 14 of tube 12 is a self-oxidizing combustible material 16 which may be of the detonating or deflagrating type to combust and transmit a signal through the length of the interior of the tube. Detonating substances may comprise a powder mixture of aluminum/HMX (A1/HMX) or any other conventional detonating mixture. The present invention is believed to be useful with any known self-oxidizing combustible material used in signal transmission tube, including a tube that is filled with a self-oxidizing combustible gas.

Deflagrating substances will preferably comprise powder mixtures of such substances as silicon/red lead ($Si/Pb_3O_4$), molybdenum/potassium perchlorate ($MO/KC10_4$), titanium hydride/potassium perchlorate ($TiH_2/KC10_4$), boron/red lead ($B/Pb_3O_4$), titanium/potassium perchlorate ($Ti/KC10_4$), zirconium/potassium perchlorate ($Zr/KC10_4$), aluminum/potassium perchlorate ($A1/KC10_4$), zirconium hydride/potassium perchlorate ($ZrH_2/KC10_4$), manganese/potassium perchlorate ($Mn/KC10_4$), zirconium nickel/red lead ($ZrNi/Pb_3O_4$), boron/barium sulfate ($B/BaSO_4$), titanium/barium sulfate ($Ti/BaSO_4$), zirconium/barium sulfate ($Zr/BaSO_4$), boron/calcium chromate ($B/CaCrO_4$), zirconium/ferric oxide ($Zr/Fe_2O_3$), titanium/stannic oxide ($Ti/SnO_2$), titanium hydride/red lead ($TiH_2/Pb_3O_4$), titanium hydride/lead chromate ($TiH_2/PbCrO_4$), and tungsten/red lead ($W/Pb_3O_4$), and tungsten/potassium perchlorate ($W/KC10_4$).

The linear signal propagation rate of the deflagrating material in the signal transmission tube may also be adjusted by the addition of gas generating materials such as, but not limited to, propellants (i.e. FNH) and explosives such as PETN, RDX, HMX, and PYX. The addition of a third component to the reactive material such as a fuel or oxidizer of greater or lesser reactivity, an inert material, a propellant, or an explosive is contemplated to better control the linear reaction rate. Alternatively, the deflagrating material can be processed with polymeric compounds such as fluorinated hydracarbons Viton®A, KEL-F® and VAAR®, a vinyl resin, and the like. Such polymers inhibit the deflagrating reaction of the compounds allowing for increased control of the propagation rate. The typical quantity of deflagrating material used is 2–500 mg/m of tube.

Compositions having a higher degree of reactivity will require greater impedance, i.e., small restriction opening and closer restriction spacing than those compositions having a lower degree of reactivity in order to modify signal transmission tube to a given slower signal velocity.

Although combustible substances 16 are shown adhered to only a portion of the interior wall 14 of tube 12, this is shown in this manner only for ease of understanding the present invention and it should be understood that such combusting substances 16 preferably line substantially all of the interior wall 14 of tube 12.

To control the velocity of signal transmission tube there are spaced at intervals along the length of signal transmission tube 10 a plurality of discrete restrictions 18 which reduce the hollow tube 12 interior axial cross section area at longitudinally spaced intervals. As seen more clearly in FIG. 2, discrete restriction 18 comprises a reduced diameter portion along the length of tube 12. Discrete restriction 18 provides a constricted diameter "b" which is less than the predetermined nominal diameter "a" of tube 12 along the interior core. In the embodiment shown in these FIGS. 1 and 2, the reduction and cross sectional area of the tube interior is determined simply by taking the differences of the axial cross sectional areas as calculated from the two diameters "a" and "b". The total length of the discrete restriction 18 is shown as "c", and the longitudinal distance or separation between restrictions 18 is shown as "d". It should be understood that in the present invention the reduction in tube interior cross sectional area should still allow for some minimum open cross-sectional area to permit the detonating or deflagrating signal to be transmitted along the transmission tube interior. The size of the minimum axial cross-sectional area may be determined by simple experimentation.

In the embodiment shown in FIGS. 1 and 2, each restriction 18 is formed by a permanently set radially inward depression 20 around the periphery of the exterior wall 13 of tube 12. This radially inward depression may be formed during the extrusion process of the tube or may be formed by deforming the tube after extrusion.

Figure 3:
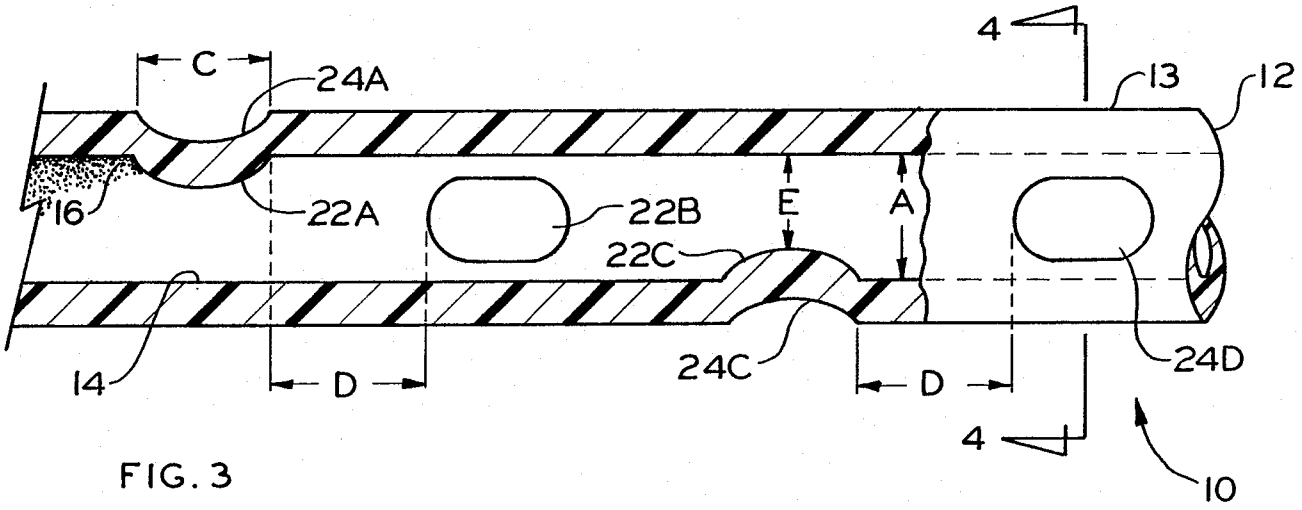
FIG. 3 is a side view, partially in section, of a second embodiment of the signal transmission tube of the present invention.
Figure 4:
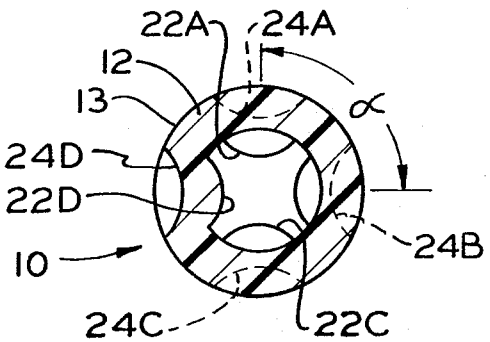
FIG. 4 is an axially cross section view of a portion of the signal transmission tube of FIG. 3.

In FIGS. 3 and 4 there is shown a second embodiment of the signal transmission tube of the present invention. Again, tube 12 is coated on its interior wall 14 with a combustible substance 16 which, for purposes of clarity, is shown as being coated on only a portion of the tube interior. To control the velocity of the detonating or deflagrating signal in this second embodiment, there is shown discrete restrictions **22*a–d*, each of which comprises a projection of length "c" which extends radially inward into the hollow of tube 12 to constrict and reduce the axial tube cross sectional area. As further shown in these FIGS. 3 and 4, the individual projection 22*a*, 22*b*, 22*c* and 22*d* are longitudinally spaced along the length of tube 12 at intervals "d" and are angularly spaced at angle alpha around the periphery of the tube interior 14**.

The discrete restrictions **22*a*, 22*b*, 22*c* and 22*d* are formed in the wall of tube 12 by permanently set dimple-type impressions 24*a*, 24*b*, 24*c* and 24*d*, respectively, in the exterior wall 13 of tube 12. As with the previous embodiments, these radially inward extending dimple-type projections may be formed in tube 12 during the extrusion process or stamped or embossed in tube 12 after extrusion. The width of the tube interior cross sectional opening at each discrete restriction 22 is shown as "e", which width is less than on the nominal inner diameter "a" of tube 12**.

The presence of the discrete restrictions along the length of the signal transmission tube interior provides a controlled series of alternating size cross-sectional area openings which create units of impedance to the transmission of a detonating or deflagrating blasting initiation signal. The degree of impedance may be increased, and the velocity of the signal transmission may be decreased, by decreasing the restriction interior opening and separation. In addition, when using restrictions which are of the dimple-type as illustrated in FIGS. 3 and 4, such restrictions may be placed at different angular positions along the length of the tube to provide further disruption and impedance of the blasting signal.

To provide greater impedance to the blasting signal, the radially inward dimple-type projections may extend to at least the center line of the central longitudinal axis of the transmission tube to reduce the width "e" of the tube interior. These relatively deep projections or restrictions will also serve to lengthen the effective path of the blasting signal, thereby further contributing to reduction of signal velocity in a given length of signal transmission tube.

Thus, the present invention provides a means to mechanically attenuate the propagation of a chemical reaction inside the signal transmission tube to reduce and control the signal velocity therein. As such, the present invention is believed to be useful with any type of self-oxidizing combustible substance used in signal transmission tube. The present invention may be used to reduce the velocity of constant internal cross-sectional area signal transmission tube by a factor of two (2) to five (5) or more.

This degree of velocity control is especially significant when used with deflagrating-type signal transmission tube having a normal signal velocity of less than about 1,500 m/sec. (4,900 ft./sec.) since signal velocity may be further reduced from these relatively slow rates.

In the method aspect of the present invention the discrete restrictions may be placed in a signal transmission tube by conventional means at any point during or after production of the tube. For example, the restrictions in the form of projections may be formed in the tube during extrusion either simultaneously with or prior to the coating of the tube interior with the self-oxidizing combustant or the placing of other combustible material within the tube. In another example, completed conventional smooth bore signal transmission tube may be hot stamped or embossed on the exterior by conventional processes to permanently deform and set the tube wall to form the interior restrictions. In this latter example, it would be possible to maintain a relatively small inventory of finished conventional signal transmission tube which may be processed quickly on demand to produce a desired signal velocity. This would present a significant improvement over the prior art which requires a large inventory of signal transmission tubes having different combustants to achieve different signal velocities.

In addition to the above, the reactivity and ignition sensitivity of the self-oxidizing combustant in signal transmission tube may now be selected independently of the tube signal velocity. Thus, where it was generally previously required to have a high ignition sensitivity, the signal transmission tube typically also displayed a high signal velocity. Such high sensitivity may now be retained in a lower velocity tube provided with discrete signal-slowing restrictions according to the teachings of the present invention.

EXAMPLE

Signal transmission tube was prepared according to the first embodiment of the present invention wherein plastic signal transmission tube made of Surlyn 8940 with a polyethylene outer layer and of nominal outer diameter of 3 mm (0.118 in) and inner diameter of 1.27 mm (0.050 in.) was provided with radial restrictions along the length of the tube at specified intervals to provide discrete restrictions of the interior cross section area. The radial restrictions were created by placing the plastic signal transmission tube within a larger aluminum tube and crimping the aluminum tube at desired intervals and to the desired degree to deform the plastic tube. The tests were conducted with two different self-oxidizing combustible substances used in signal transmission tube. The test conditions for each mixture, aluminum/HMX (a detonating mixture) and tungsten/-potassium perchlorate (a deflagrating mixture), were varied to test different tube interior restriction diameters and separation distances. The results of these tests are shown below in Table I.

TABLE I

| Restriction | | | | Propagation Rate ms/m (ms/ft) | | | |
|---|---|---|---|---|---|---|---|
| Orifice Inside Opening - b mm (in.) | | Separation - d mm (in.) | | $W/KClO_4$ (65/35 wt % mix) | | Al/HMX (10.5/89.5 wt % mix) | |
| 0.28 | (0.011) | 6.4 | (0.25) | Fail | | Fail | |
| 0.51 | (0.020) | 6.4 | (0.25) | 5.9 | (1.8) | 1.81 | (.551) |
| 1.07 | (0.042) | 6.4 | (0.25) | 1.8 | (0.55) | — | |
| 0.28 | (0.011) | 12.7 | (0.50) | 7.5 | (2.3) | 2.46 | (.749) |
| 0.51 | (0.020) | 12.7 | (0.50) | 4.1 | (1.25) | 1.80 | (.550) |
| 1.07 | (0.042) | 12.7 | (0.50) | 1.8 | (0.55) | — | |
| 0.28 | (0.011) | 25.4 | (1.0) | 7.9 | (2.4) | 1.84 | (.562) |
| 0.51 | (0.020) | 25.4 | (1.0) | 3.2 | (0.97) | 0.66 | (.200) |
| 1.07 | (0.042) | 25.4 | (1.0) | 1.5 | (0.46) | — | |
| 0.28 | (0.011) | 50.8 | (2.0) | 5.6 | (1.7) | 1.12 | (.341) |
| 0.51 | (0.020) | 50.8 | (2.0) | 2.5 | (0.77) | 0.68 | (.207) |
| 1.07 | (0.042) | 50.8 | (2.0) | 1.5 | (0.46) | — | |
| 0.28 | (0.011) | 152 | (6.0) | Fail | | 1.01 | (.308) |
| 0.51 | (0.020) | 152 | (6.0) | 1.8 | (0.54) | 0.60 | (.183) |
| 1.07 | (0.042) | 152 | (6.0) | 1.4 | (0.44) | — | |
| None* | | — | | 1.3 | (0.40) | 0.52 | (.159) |

*control sample

As can be seen from the results from the aforementioned tests, the presence of longitudinally spaced discrete restrictions along the interior of the signal transmission tube resulted in a reduced and controlled velocity of signal transmission as compared to the control sample having no interior restrictions. Thus, the present invention provides for the control of transmission tube signal velocity by mechanical means and independent of the composition of the combustible substance inside the tube.

As will be apparent to persons skilled in the art, various modifications, adaptations and variations of the foregoing specific disclosure can be made without departing from the spirit and scope of this invention.

Having thus described the invention what is claimed is:

1. Signal transmission tube comprising a length of elongated hollow tube and a self-oxidizing combustible substance disposed along the interior surface of said tube for transmitting a blasting signal along the interior of said tube length, said tube having mechanical means for controlling blasting signal velocity including a plurality of discrete locations of reduced axial cross-sectional area at longitudinally spaced intervals along said tube length for reducing and controlling the velocity of said blasting signal and reduced areas being permanently set, said tube having a continuous open interior passageway throughout its length permitting bidirectional blasting signal transmission therein.

2. The transmission tube of claim 2 wherein the varying interior axial cross sectional area is formed by longitudinally spaced discrete restrictions in the interior of said hollow tube.

3. The transmission tube of claim 1 wherein the spaced discrete restrictions each comprise a region of constricted tube interior width.

4. The transmission tube of claim 2 wherein the spaced discrete restrictions each comprise a region of constricted tube interior diameter.

5. The transmission tube of claim 2 wherein the spaced discrete restrictions comprise radially inward projections formed by the wall of the tube interior.

6. The transmission tube of claim 5 wherein said discrete projections are angularly spaced about the interior of said tube along said tube length.

* * * * *

UNITED STATES PATENT AND TRADEMARK OFFICE

CERTIFICATE OF CORRECTION

PATENT NO. : 4,838,165

DATED : June 13, 1989

INVENTOR(S) : Ernest L. Gladden and Sanford B. Tavelli

It is certified that error appears in the above-identified patent and that said Letters Patent is hereby corrected as shown below:

Column 1, line 31, wherein the word "i" should be --I--.

Column 7, line 14, wherein the number "2" should be --1--.

Column 8, line 3, wherein the number "1" should be --2--.

Signed and Sealed this

Eleventh Day of September, 1990

*Attest:*

HARRY F. MANBECK, JR.

*Attesting Officer*

*Commissioner of Patents and Trademarks*